US010946299B1

(12) United States Patent
Hsu

(10) Patent No.: US 10,946,299 B1
(45) Date of Patent: Mar. 16, 2021

(54) ILLUMINATED MULTI-COLOR SPINNER ASSEMBLY

(71) Applicant: Lorraine Melody Hsu, Santa Ana, CA (US)

(72) Inventor: Lorraine Melody Hsu, Santa Ana, CA (US)

( * ) Notice: Subject to any disclaimer, the term of this patent is extended or adjusted under 35 U.S.C. 154(b) by 0 days.

(21) Appl. No.: 16/739,353

(22) Filed: Jan. 10, 2020

(51) Int. Cl.
*A63H 33/26* (2006.01)
*A63H 33/22* (2006.01)

(52) U.S. Cl.
CPC ..... *A63H 33/26* (2013.01); *A63H 33/22* (2013.01)

(58) Field of Classification Search
CPC . A63H 1/00; A63H 1/24; A63H 33/00; A63H 33/20; A63H 33/22; A63H 3/006; A63H 17/28
USPC ..... 446/219, 242, 485
See application file for complete search history.

(56) References Cited

U.S. PATENT DOCUMENTS

| | | | | |
|---|---|---|---|---|
| 6,589,094 | B2 | 7/2003 | Spencer | |
| 6,692,001 | B2 * | 2/2004 | Romano | A63F 9/12 273/156 |
| D504,706 | S | 5/2005 | Bennett | |
| 2002/0068505 | A1 | 6/2002 | Williams | |
| 2003/0228828 | A1 | 12/2003 | Coleman et al. | |
| 2010/0124867 | A1 | 5/2010 | Kessler | |
| 2013/0309940 | A1 * | 11/2013 | Miyako | A63H 33/22 446/485 |
| 2016/0018083 | A1 | 1/2016 | Kelly et al. | |

FOREIGN PATENT DOCUMENTS

WO WO2006096705 A2 9/2006

* cited by examiner

*Primary Examiner* — Kien T Nguyen
(74) *Attorney, Agent, or Firm* — Bacon & Thomas, PLLC

(57) ABSTRACT

An illuminated spinner having a handle, a motor within the handle controlled by a switch on the handle, a shaft extending from the handle, and a spinning object on which a lighting element is mounted, is provided with a decorative shell that encloses the object and is mounted on the handle, and that is constructed of at least three translucent pieces, as least two of which have different color transmitting or abo properties. The at least one light source is visible through the shell over an angle of 360® when the object is spinning and the light source is illuminated.

11 Claims, 2 Drawing Sheets

ILLUMINATED MULTI-COLOR SPINNER ASSEMBLY

BACKGROUND OF THE INVENTION

1. Field of the Invention

The invention relates to a spinner device, and more particularly to a hand-held light-emitting novelty item or toy that includes a handle, a motor and power source located in the handle, a shaft extended from a top of the handle, a spinning structure attached to the shaft, the spinning structure having at least one lighting element affixed thereto, and a transparent or translucent shell fixed to the handle and enclosing the spinning structure to allow the spinning structure and lighting element to be viewed as it is rotated by the motor and shaft.

2. Description of Related Art

The present invention provides an improvement on a type of illuminated novelty item or toy known as a spinner. Illuminated spinners are handheld devices similar to light sticks or flashlights, but that add motion to the lighting effects by placing the light source on a rotating element activated by a switch on a handle by the spinner, thereby providing a unique and eye-catching display that can be used for play or to enhance festive events or occasions such as fairs and carnivals.

Examples of illuminated spinners are disclosed in U.S. Patent Publication Nos. 2013/0309940, 2010/0124867 and 2002/0068505, and U.S. Pat. Nos. 6,589,094 and D504,706. Each of these publications and patents discloses a spinner assembly that includes a handle, a motor in the handle, a switch on the handle for turning the motor on and off, a shaft extending from the handle and rotated by the motor, and a spinning structure connected to the shaft to rotate with the shaft, the spinning structure including at least one lighting element that turns on when the spinning structure is rotated in response to user-manipulation of the switch.

In each of the prior illuminated spinners, the spinning object is enclosed within a transparent or translucent shell fixed to the handle. The shell typically consists of two halves that are joined together along a vertical or horizontal plane to enclose the spinning object. While the halves can have a variety of configurations, ranging from hemispheres to shapes that, when the halves are joined, form a character shape, the halves are generally made of an identical transparent or translucent material so that the spinning object and light can be viewed from multiple sides. Although coloring is possible, by selecting a material for the shell that transmits light of a desired color, the two halves are conventionally made of material having the same color transmitting properties. Additional features of the character formed by the shell, or additional decoration, is achieved by painting, printing, or silk-screening the additional features or decoration onto the shell, or applying stickers or decals. However, the opaqueness of the added features detracts from the lighting effects provided by the spinner, especially in a dark environment.

The present invention addresses this problem by constructing the shell of more than two pieces made of respective translucent materials having different optical properties, and in particular different color transmitting and/or absorption properties, thereby providing decorative effects visible in a daylight or bright environment when the spinner is not illuminated, and that that enhance rather than detract from the lighting effects in a dark environment.

The present invention thus addresses the limitations of a spinner with a two-piece shell by forming the shell from more than two pieces, at least two of the pieces having different optical properties. Although it is known to provide spinners with multiple-piece objects, with or without surrounding shells, it is conventional to form the shells, like the handles, of only two pieces. By way of background, examples of non-illuminated spinners with multiple-piece spinners, as opposed to multiple-piece shells, are found in U.S. Patent Publication 2016/0018083 (which discloses a modular user-customizable spinning object) and 2013/02288828 (which discloses a spinning multiple piece lollipop with three different flavors), while an illuminated spinner with an opaque shell having multiple blades that open in response to centrifugal force when the spinner rotates is disclosed in PCT Publication No. WO2006/096705. None of these multiple piece spinner constructions includes a shell that surrounds the spinner and through which the spinner and lighting element or elements are viewed.

SUMMARY OF THE INVENTION

It is a first objective to provide a toy or novelty item having enhanced decorative and illumination effects.

It is a second objective of the invention an illuminated handheld spinner with enhanced decorative and illumination effects.

It is a third objective of the invention to provide an illuminated spinner having a shell that includes decorative features visible in daylight when the shell is not illuminated, and that provide more effective and versatile lighting effects in a dark environment.

One or more of these objectives is achieved by a preferred embodiment of the invention in which an illuminated spinner having a handle, a motor situated within the handle and controlled by a switch on the handle, a shaft extending from the handle, and a spinning object on which a lighting element is mounted, is further provided with a decorative shell that encloses the object and is secured to the handle, the shell being constructed of at least three pieces, at least two of which have different optical properties.

According to a preferred embodiment of the invention, the different optical properties are color transmitting and/or absorbing properties, and the at least three pieces of the shell are each translucent, so that the spinning lighting element is visible over an angle of 360 degrees around the shell.

The shell may be in the form of a character or figure. By way of example and not limitation, the character or figure formed by the shell may be a representation of an Easter bunny or chick, another seasonal object such as a snowman or jack-o-lantern, or any other aesthetic, promotional, or seasonal shape.

DETAILED DESCRIPTION OF THE PREFERRED EMBODIMENTS

Figure 1:
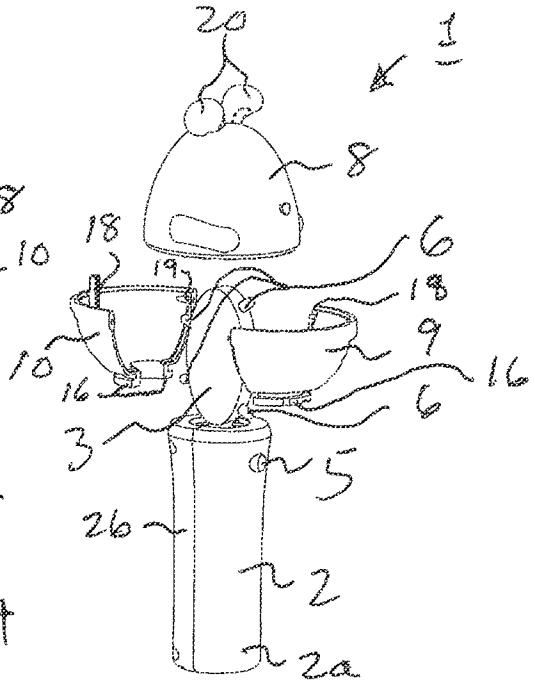
FIG. 1 is an exploded isometric view of an illuminated spinner constructed in accordance with principles of a preferred embodiment of the invention.

FIGS. 1-7 show a spinner 1 constructed in accordance with the principles of a first preferred embodiment of the present invention.

The spinner includes a handle 2 that contains a motor (not shown) having a shaft attached to a spinning object 3, and one or more batteries (not shown). The batteries may be in the form of a stack of disc batteries positioned in a battery compartment having a battery compartment cover 4. An on/off switch 5 extends from the handle 2 to turn on and off the motor. The switch 5 also causes illumination of one or more light sources 6 positioned on the spinning object 3.

The handle 2, motor, batteries, and switch 5 of the illustrated spinner 1, as well as circuitry for controlling the motor and light sources 6 are all conventional, commercially-available, and well-known to those skilled in the art, although the invention is not limited to a particular handle, motor, battery and circuit configuration. For example, the batteries may include one or more disc batteries or one or more AA or AAA type batteries, and the switch 5 may be replaced by a button or touch switch. Also, the handle 2 may be constructed of, for example, two main cylinder halves 2*a* and 2*b* to form a generally cylindrically shaped handle that can easily be gripped by a user, with the switch 5 positioned in the front half 2*a* so that it can be manipulated by the user's thumb in order to turn the spinner and lights on and off when the handle is held between the user's fingers and palm, as is known in the art.

The shape of the spinning object 3, while illustrated as a disc, may be freely varied, as may the materials, configuration, and/or other construction details of the object. Also, the light sources 6 may for example include one or more LEDs, EL elements, and/or other light sources, and may further include additional optical elements or structures such as optical fibers, reflectors, lens, and so forth, while the number of the light sources, and the manner in which they are mounted on the spinning object and connected to circuitry in the handle, may also be varied. The circuitry for connecting or controlling the lights sources to power sources in the handle may not only include on/off circuitry but also flasher circuitry, and the LEDs or other light sources may have single or multiple colors.

Surrounding the spinning object 3 and the light sources 6 is a shell 7 made up of at least three pieces 8-10. Pieces 8-10 are each made of a translucent material through which the spinning lights source 6 are visible when illuminated. Lower pieces 8 and 9 are each made of a colored translucent material, for example a material that transmits blue wavelengths and/or absorbs wavelengths other than blue, while upper piece 10 is made of a translucent material that transmits wavelengths (or a combination of wavelengths) to impart a different color, such as white, to the transmitted light. When the light sources 6 are not illuminated, each of the translucent pieces appears to be an opaque colored piece, and the light sources 6 are not visible. In this example, the spinning disc itself is not visible even when the light sources 6 are illuminated, so that the light will appear to rotate in space within the interior of the shell 7. Although three pieces are shown, the number of pieces that make up the shell may be more than three to achieve additional decorative lighting effects The three pieces 8-10 together form the shape of a character. In the example of FIGS. 1-7, the character is a bunny. In the example of FIGS. 8-14, the three pieces 8*a*, 9*a*, and 10*a* form a shell 15 in the shape of a hen, but the construction of the spinner 1*a* of FIGS. 8-14 is otherwise identical to that of the spinner 1 of FIGS. 1-7, and the pieces 8*a*, 9*a*, and 10*a* of the shell 15 of spinner 1*a* are also made of respective colored translucent materials corresponding to those of the spinner 1.

Figure 5:
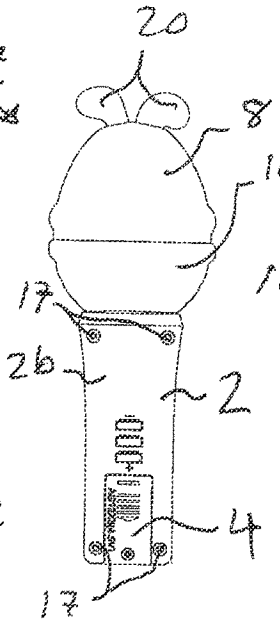
FIGS. 2-5 are respective left, front, right, and back views of the illuminated spinner of FIG. 1.
Figure 4:
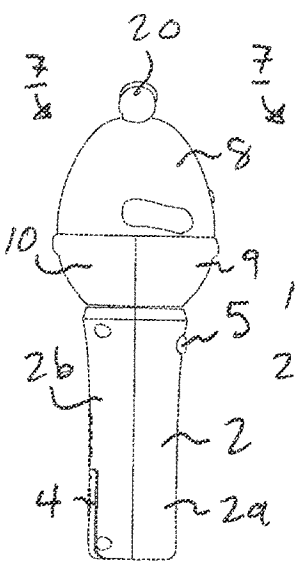
Figure 6:
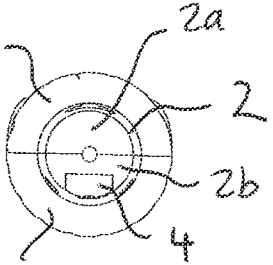
FIG. 6 is a bottom view of the illuminated spinner of FIGS. 1-5.
Figure 3:
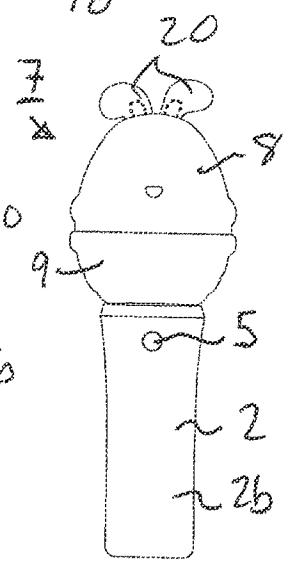
Figure 7:
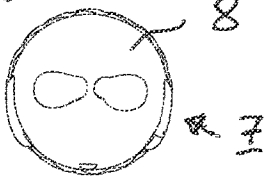
FIG. 7 is atop view of the illuminated spinner of FIGS. 1-6.
Figure 2:
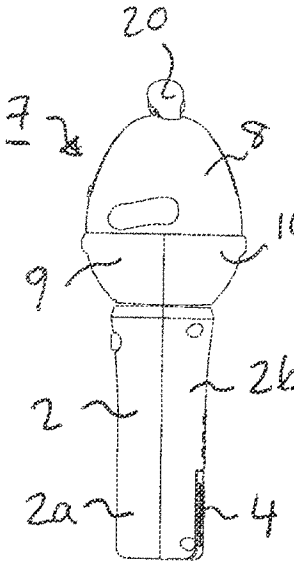
Figures 8, 9, 10, 11, 12, 13, 14:
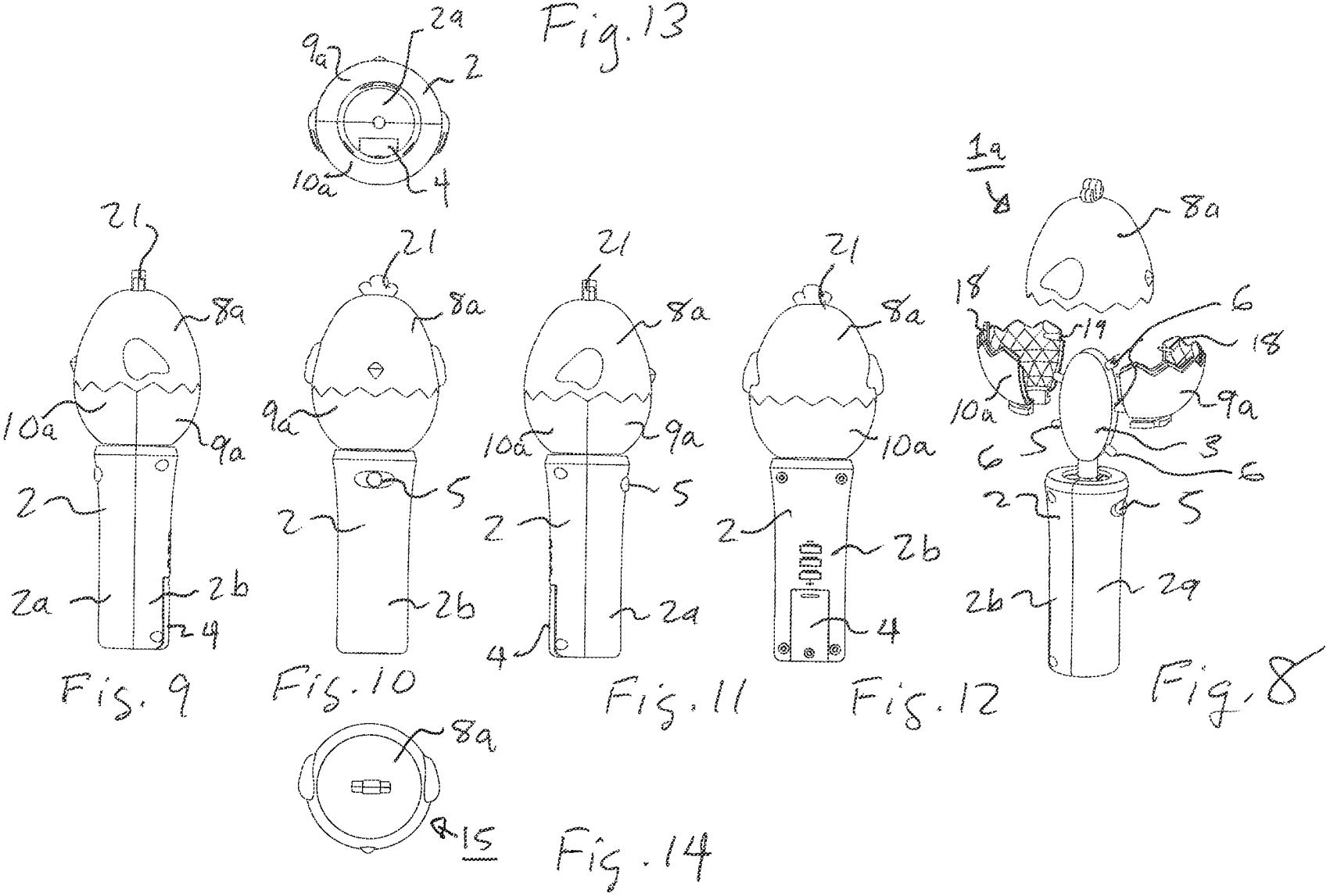
FIGS. 8-14 are respective isometric, left, front, right, back, bottom, and top views of a variation of the spinner of FIGS. 1-7.

In both examples, the shells 7 and 15 may include optional additional structures such as flanges 16 captured by a corresponding inwardly extending rim on the handle two secure the shell to the handle when the two pieces of the handle are fastened together by fastening means such as the screws 17 visible in FIGS. 5 and 12. The parts of the shells 7 and 15 may also include optional alignment features such as posts 18 and holes or grooves 19 to facilitate assembly, and optional decorative appendages such as the bunny ears 20 or chicken "comb" 21. These and further modifications of the illustrated embodiments are intended to be included within the scope of the invention, which may also involve the inclusion of additional shell parts, modifications to the illuminated spinner, and variations in the appearance of any decorative parts or appendages.

What is claimed is:

1. An illuminated spinner, comprising:

a handle, a spinning object, at least one light source mounted on and rotatable with the spinning object, and a switch on an outside of the handle, the switch being manipulatable by a user to selectively cause the spinning object to rotate and the at least one light source to illuminate; and a shell secured to the handle and enclosing the spinning object and at least one light source, wherein:

the shell is formed by at least three pieces, each made of a light-transmitting material, and at least two of the pieces have different optical properties, whereby the at least one light source is visible through the shell.

2. An illuminated spinner as claimed in claim 1, wherein the different optical properties are color transmission or absorption properties.

3. An illuminated spinner as claimed in claim 1, wherein two of the pieces have a same color transmitting property and at least one third piece has a different color transmitting property.

4. An illuminated spinner as claimed in claim 3, wherein each of the pieces of the shell is made of a translucent material so that the at least one light source, when illuminated, is visible over an angle of 360 degrees around a circumference of the shell.

5. An illuminated spinner as claimed in claim 1, wherein each of the pieces of the shell is made of a translucent material so that the at least one light source, when illuminated, is visible over an angle of 360 degrees around a circumference of the shell.

6. An illuminated spinner as claimed in claim 1, wherein the at least three pieces collectively form a character shape.

7. An illuminated spinner as claimed in claim 1, wherein a number of the pieces is three.

8. An illuminated spinner as claimed in claim 1, wherein the handle includes a battery compartment for removably housing at least one battery that supplies power to a motor and the at least one light source.

9. An illuminated spinner as claimed in claim 1, wherein the spinning object is a disc and the at least one light source includes multiple LEDs mounted to the disc.

10. An illuminated spinner as claimed in claim 1, wherein the spinning object is not visible through the shell.

11. An illuminated spinner as claimed in claim 1, wherein the handle includes two halves assembled together to form a cylinder.

* * * * *